US005691271A

United States Patent [19]

Yanagihara et al.

[11] Patent Number: 5,691,271

[45] Date of Patent: Nov. 25, 1997

[54] INDOLYLAZAPHTHALIDES AND RECORDING MATERIALS CONTAINING THE SAME

[75] Inventors: Naoto Yanagihara, Shizuoka; Kiyoshi Takeuchi, Kanagawa; Toyohisa Oya, Kanagawa; Naoki Asanuma, Kanagawa; Masanobu Takashima; Syunsaku Higashi, both of Shizuoka, all of Japan

[73] Assignee: Fuji Photo Film Co., Ltd., Kanagawa, Japan

[21] Appl. No.: 648,830

[22] Filed: May 16, 1996

[30] Foreign Application Priority Data

May 17, 1995 [JP] Japan ..... 7-118782
Oct. 11, 1995 [JP] Japan ..... 7-263052

[51] Int. Cl.[6] ..... B41M 5/136; B41M 5/30; B41M 5/34

[52] U.S. Cl. ..... 503/204; 503/216; 503/217; 503/220

[58] Field of Search ..... 503/204, 217, 503/220, 208, 209, 215, 216; 427/151

[56] References Cited

FOREIGN PATENT DOCUMENTS

| | | | |
|---|---|---|---|
| 61-4856 | 2/1986 | Japan | 503/220 |
| 61-168664 | 7/1986 | Japan | 503/220 |
| 61-291654 | 12/1986 | Japan | 503/220 |
| 62-270662 | 11/1987 | Japan | 503/220 |

*Primary Examiner*—Bruce H. Hess
*Attorney, Agent, or Firm*—Sughrue, Mion, Zinn, Macpeak & Seas, PLLC

[57] ABSTRACT

The present invention provides novel indolylazaphthalides represented by formula (I) described below. The indolylazaphthalides are useful as electron donative colorless dyes for preparing recording materials. Recording materials containing the novel indolylazaphthalides of formula (I) as electron donative colorless dyes provide images having blue to cyan colors at an excellent density, while suppressing light coloration in non-image areas.

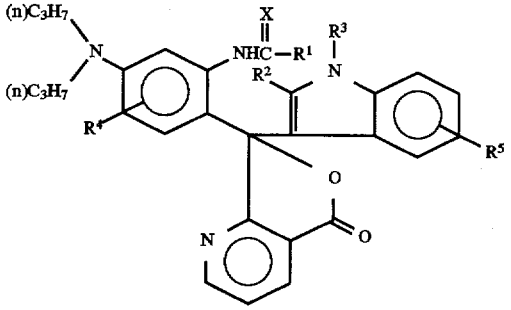

(I)

wherein $R^1$ represents a divalent linkage group such as an alkylene group, cycloalkylene group, aralkylene group, or a phenylene group, which linkage group is linked to a bimolecular indolylazaphthalide compound to form a bis-type structure.

11 Claims, No Drawings

INDOLYLAZAPHTHALIDES AND RECORDING MATERIALS CONTAINING THE SAME

BACKGROUND OF THE INVENTION

1. Field of the Invention

The present invention relates to novel indolylazaphthalides and recording materials containing indolylazaphthalides. The indolylazaphthalides according to the present invention are useful as electron donative colorless dyes for preparing recording materials containing electron donative colorless dyes and electron accepting compounds, particularly for preparing pressure-sensitive recording materials, heat-sensitive recording materials, etc.

2. Description of the Related Art

Recording materials containing electron donative colorless dyes and electron accepting compounds are well known as pressure-sensitive papers, heat-sensitive papers, light- and pressure-sensitive papers, electric heat-sensitive papers, heat-sensitive printing papers, etc. For example, they are described in U.K. Patent No. 2,140,449, U.S. Pat. Nos. 4,480,052 and 4,436,920, Japanese Patent Application Publication (JP-B) No. 60-23992, Japanese Patent Application Laid-Open (JP-A) Nos. 57-179836, 60-123556, and 60-123557.

In recent years, extensive studies have been conducted in the field of recording materials in order to improve characteristics of recording materials, including image density, fastness of image portions, and fastness of white background areas.

As electron donative colorless dyes which provide images having blue to cyan colors, various compounds are known including triphenylmethanephthalides, phenothiazines, and indolylphthalides.

Several examples are known of so-called indolylazaphthalides, which are indolylphthalides in which a carbon atom of the benzene ring in the phthalide moiety is replaced by nitrogen. Specifically, they are described in detail in Japanese Patent Application Publication (JP-B) No. 61-4856, Japanese Patent Application Laid-Open (JP-A) Nos. 61-168664, 61-291654, and 62-270662. Of the indolylazaphthalides described in these publications, some provide images having blue to cyan colors at an excellent density. However, even such compounds do not satisfy all the desired quality standards including that image portions have good fastness against light and heat and that light- coloration of non-image portions is suppressed.

SUMMARY OF THE INVENTION

An object of the present invention is to provide a novel compound useful as an electron donative colorless dye capable of producing an image having blue to cyan colors at an excellent density and having reduced light-coloration at non-image portions.

The present inventors have conducted careful studies of compounds which are useful as electron donative colorless dyes providing images having blue to cyan colors at an excellent density and which simultaneously satisfy the above-described qualities. As a result, they discovered novel indolylazaphthalides which satisfy the desired quality standards.

Briefly, the above object was achieved through the discovery of an indolylazaphthalide compound represented by the following formula (I) as well as through the realization of a recording material constituted by an electron donative colorless dye and an electron accepting compound, the material comprising at least one indolylazaphthalide compound represented by the following formula (I):

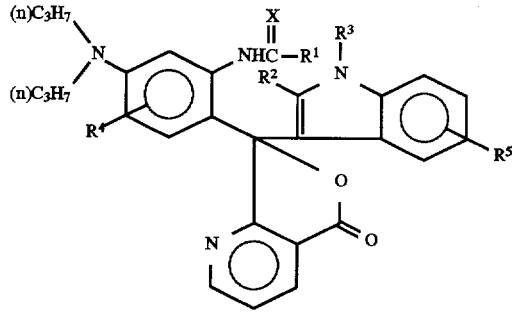

(I)

wherein $R^1$ represents an alkyl group, a cycloalkyl group, an aralkyl group, an aryl group, or a heterocyclic group; each of $R^2$ and $R^3$ represents a hydrogen atom, an alkyl group, or an aryl group; each of $R^4$ and $R^5$ represents a hydrogen atom, an alkyl group, an alkoxy group, or a halogen atom; and X represents an oxygen atom or a sulfur atom.

Recording materials according to the present invention incorporating one or more of the above indolylazaphthalides provide images having blue to cyan colors at an excellent density, and suppress light coloration in non-image areas.

DESCRIPTION OF THE PREFERRED EMBODIMENTS

The indolylazaphthalides according to the present invention are represented by the following formula (I):

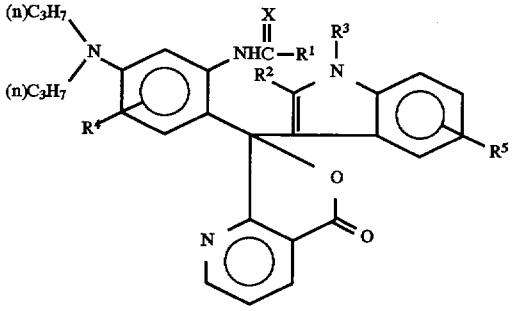

(I)

and they will next be described in detail.

In the above formula (I), $R^1$ represents an alkyl group, a cycloalkyl group, an aralkyl group, an aryl group, or a heterocyclic group as described above. $R^1$ is preferably an alkyl group containing 1 to 18 carbon atoms, a cycloalkyl group containing 5 to 6 carbon atoms, an aralkyl group containing 7 to 15 carbon atoms, or an aryl group containing 6 to 12 carbon atoms. More preferably, $R^1$ is an alkyl group containing 1 to 12 carbon atoms, a cycloalkyl group containing 5 to 6 carbon atoms, an aralkyl group containing 7 to 12 carbon atoms, or an aryl group containing 6 to 12 carbon atoms. $R^1$ may be substituted by an alkoxy group or a halogen atom.

Specific examples of preferred species of $R^1$ include methyl, ethyl, n-propyl, i-propyl, n-butyl, i-butyl, sec-butyl, t-butyl, n-pentyl, i-pentyl, n-hexyl, n-octyl, 2-ethylhexyl, n-decyl, n-dodecyl, cyclopentyl, cyclohexyl, benzyl, 2-phenethyl, 1-phenethyl, phenyl, p-tolyl, chloromethyl, dichloromethyl, trichloromethyl, and trifluromethyl. Of heterocyclic groups represented by $R^1$, those represented by the following formulas are preferred.

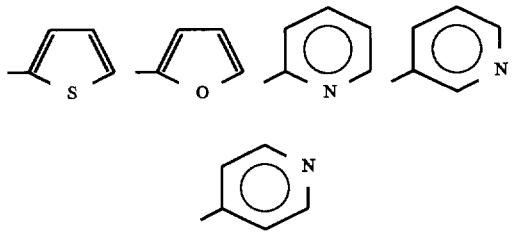

$R^1$ may also be a divalent linkage group which is linked to bimolecular indolylazaphthalide compound to form a bis-type structure. Examples of such a divalent linkage group include an alkylene group, cycloalkylene group, aralkylene group, and a phenylene group. In this case, examples of preferred divalent linkage groups include ethylene, propylene, butylene, octylene, cyclohexylene, xylylene, methylxylylene, and phenylene.

In the above formula (I), $R^2$ is preferably a hydrogen atom, an alkyl group containing 1 to 4 carbon atoms, or an aryl group containing 6 to 10 carbon atoms, with a hydrogen atom, a methyl group, and a phenyl group being particularly preferred. The phenyl group may have a substituent.

In the above formula (I), $R^3$ is preferably a hydrogen atom, an alkyl group containing 1 to 18 carbon atoms, or an aryl group containing 6 to 15 carbon atoms; with an alkyl group containing 1 to 12 carbon atoms and an aryl group containing 6 to 10 carbon atoms being particularly preferred. These groups may be substituted by, for example, an alkyl group containing 1 to 8 carbon atoms, an alkoxy group containing 1 to 8 carbon atoms, an aryl group containing 6 to 10 carbon atoms, an aryloxy group containing 6 to 10 carbon atoms, or a halogen atom.

Specific examples of preferred species of $R^3$ include hydrogen, methyl, ethyl, n-propyl, i-propyl, n-butyl, i-butyl, sec-butyl, t-butyl, n-pentyl, i-pentyl, n-hexyl, n-octyl, 2-ethylhexyl, n-decyl, n-dodecyl, cyclopentyl, cyclohexyl, benzyl, 2-phenethyl, 1-phenethyl, phenyl, p-tolyl, p-methoxyphenyl, p-chlorophenyl, 2-methoxyethyl, 2-(2-methoxyethoxy)ethyl, 2-phenoxyethyl, 2-phenoxypropyl, 3-phenoxypropyl, and 2-chloroethyl.

In the above formula (I), each of $R^4$ and $R^5$ is preferably a hydrogen atom, an alkyl group containing 1 to 4 carbon atoms, an alkoxy group containing 1 to 4 carbon atoms, or a chlorine atom. Hydrogen, methyl, i-propyl, methoxy, ethoxy, and chlorine are particularly preferred.

In the above formula (I), X is preferably an oxygen atom.

Specific indolylazaphthalides according to the present invention will next be described, which should not be construed as limiting the present invention.

TABLE 1

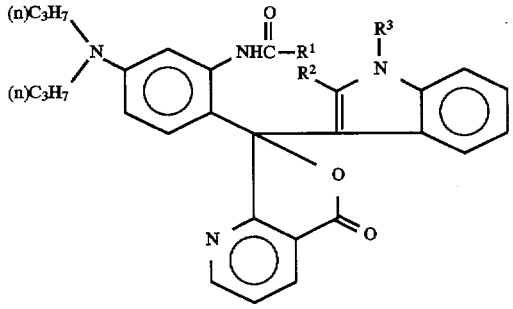

| | $R^1$ | $R^2$ | $R^3$ |
|---|---|---|---|
| I-1 | $-CH_3$ | $-CH_3$ | $-C_2H_5$ |
| I-2 | $-C_2H_5$ | $-CH_3$ | $-C_2H_5$ |
| I-3 | $-CH(CH_3)_2$ | $-CH_3$ | $-C_2H_5$ |
| I-4 | $-C(CH_3)_3$ | $-CH_3$ | $-C_2H_5$ |
| I-5 | $-CH_2-C_6H_5$ | $-CH_3$ | $-C_2H_5$ |
| I-6 | $-C_6H_5$ | $-CH_3$ | $-C_2H_5$ |
| I-7 | $-CH_2OCH_3$ | $-CH_3$ | $-C_2H_5$ |
| I-8 | $-CH_2Cl$ | $-CH_3$ | $-C_2H_5$ |
| I-9 | $-CCl_3$ | $-CH_3$ | $-C_2H_5$ |
| I-10 | $-CF_3$ | $-CH_3$ | $-C_2H_5$ |
| I-11 | $-C_6H_{11}$ | $-CH_3$ | $-C_2H_5$ |
| I-12 | $-C_4H_3S$ | $-CH_3$ | $-C_2H_5$ |
| I-13 | $-CH_2CH_2CH_3$ | $-CH_3$ | $-C_2H_5$ |
| Ia-1 | $-(n)C_5H_{11}$ | $-CH_3$ | $-C_2H_5$ |
| Ia-2 | $-(n)C_7H_{15}$ | $-CH_3$ | $-C_2H_5$ |
| Ia-3 | $-(n)C_{17}H_{35}$ | $-CH_3$ | $-C_2H_5$ |
| Ia-4 | $-CH(C_6H_5)_2$ | $-CH_3$ | $-C_2H_5$ |
| Ia-5 | $-CH_2O-C_6H_5$ | $-CH_3$ | $-C_2H_5$ |

TABLE 1-continued

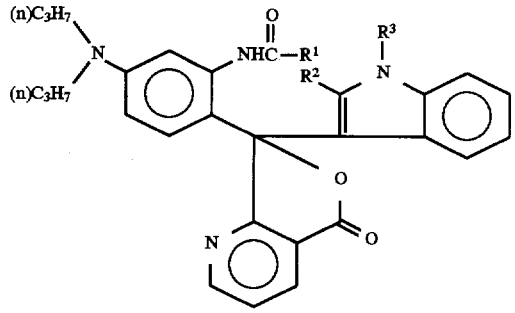

| | $R^1$ | $R^2$ | $R^3$ |
|---|---|---|---|
| Ia-6 | 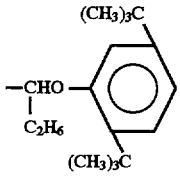 | $-CH_3$ | $-C_2H_5$ |

TABLE 2

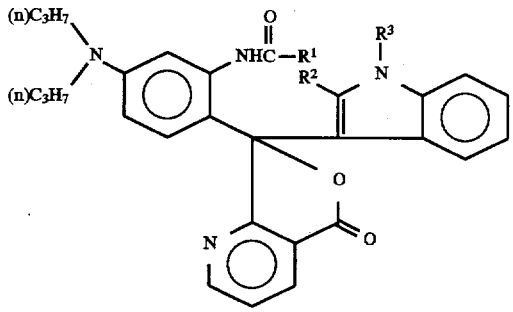

| | $R^1$ | $R^2$ | $R^3$ |
|---|---|---|---|
| I-14 | $-CH_3$ | $-CH_3$ | $-(n)C_4H_9$ |
| I-15 | $-CH_3$ | $-CH_3$ | $-(n)C_8H_{17}$ |
| I-16 | 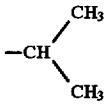 | $-CH_3$ | $-(n)C_4H_9$ |
| I-17 | 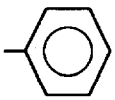 | $-CH_3$ | $-(n)C_5H_{11}$ |
| I-18 | $-CH_2OCH_3$ | $-CH_3$ | $-(n)C_8H_{17}$ |
| I-19 | $-CH_3$ | $-CH_3$ | 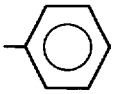 |
| I-20 | 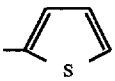 | $-CH_3$ | $-(n)C_6H_{13}$ |
| Ia-7 | $-CH_3$ | $-CH_3$ | $-(n)C_5H_{11}$ |

TABLE 2-continued

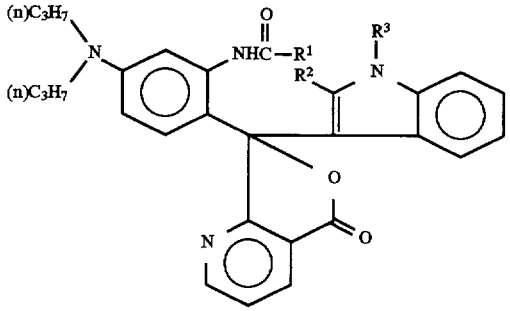

| | $R^1$ | $R^2$ | $R^3$ |
|---|---|---|---|
| Ia-8 | $-CH_3$ | $-CH_3$ | 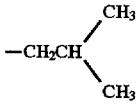 |
| Ia-9 | $-(n)C_3H_7$ | $-CH_3$ | $-(n)C_8H_{17}$ |
| Ia-10 | $-(n)C_4H_9$ | $-CH_3$ | $-(n)C_8H_{17}$ |
| Ia-11 | 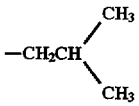 | $-CH_3$ | $-(n)C_8H_{17}$<br>$-(n)C_8H_{17}$ |
| Ia-12 | $-(t)C_3H_7$ | $-CH_3$ | $-(n)C_8H_{17}$ |
| Ia-13 | $-(t)C_4H_9$ | $-CH_3$ | $-(n)C_8H_{17}$ |
| Ia-14 | 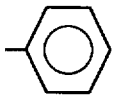 | $-CH_3$ | $-(n)C_8H_{17}$ |
| Ia-15 | 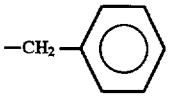 | $-CH_3$ | $-(n)C_8H_{17}$ |
| Ia-16 | 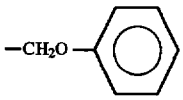 | $-CH_3$ | $-(n)C_8H_{17}$ |
| Ia-17 | $-(n)C_3H_7$ | $-CH_3$ | 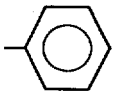 |
| Ia-18 | $-CH_3$ | $-CH_3$ | 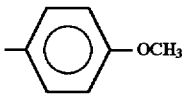 |

TABLE 3

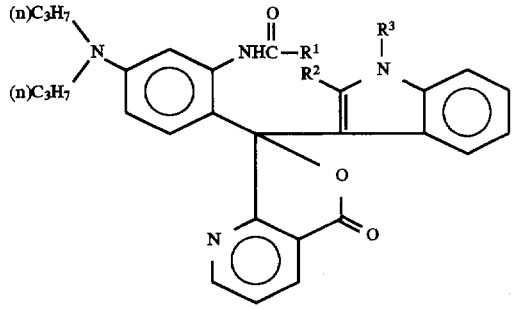

| | $R^1$ | $R^2$ | $R^3$ |
|---|---|---|---|
| I-21 | $-CH_3$ | 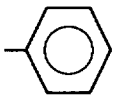 | $-C_2H_5$ |
| I-22 | $-CH_3$ | 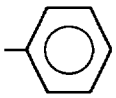 | $-(n)C_8H_{17}$ |

I-23

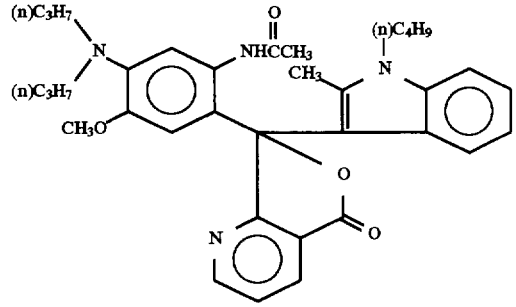

I-24

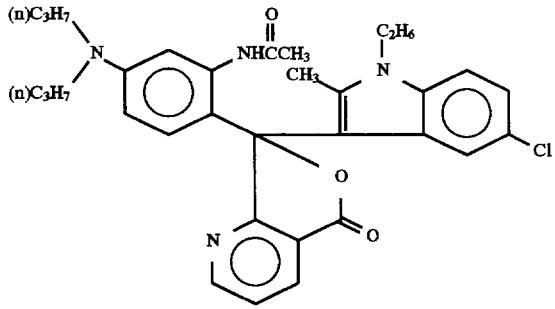

I-25

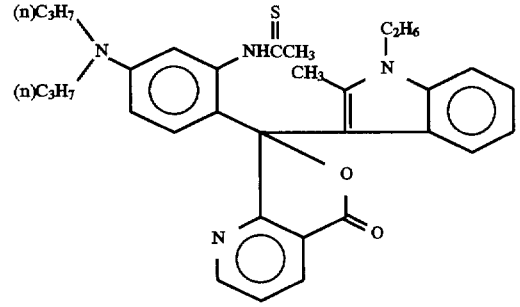

TABLE 3-continued

I-26

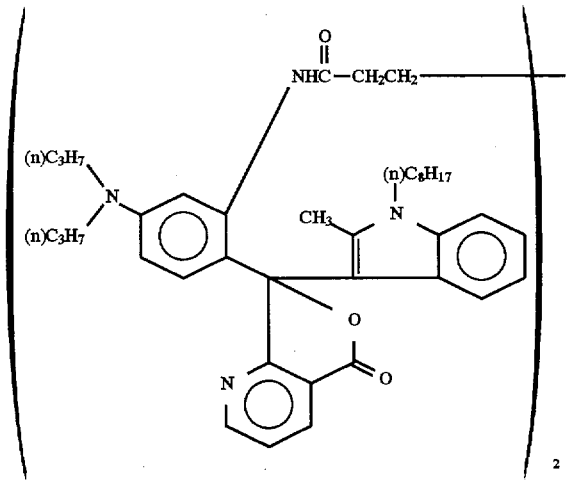

The indolylazaphthalides of the present invention are prepared via methods described in Japanese Patent Application Publication (JP-B) No. 61-4856, Japanese Patent Application Laid-Open (JP-A) No. 62-270662, etc.

The indolylazaphthalides of the present invention may include 7-azaphthalides, which are isomer mixtures by-produced during the production of indolylazaphthalides.

When the indolylazaphthalides of the present invention are used as for preparing recording materials, indolylazaphthalides may be used singly or in combinations of two or more species.

When recording materials of the present invention are manufactured, in addition to the indolylazaphthalides of the present invention which are used as electron donative colorless dyes, a variety of other compounds which are conventionally known to be electron donative colorless dyes may also be co-used so long as the effect of the present invention is not impeded. Examples of such other compounds include triphenylmethanephthalides, fluorans, phenothiazines, indolylphthalides, leucoauramines, Rhodaminelactams, triphenylmethanes, triazenes, spiropyrans, and fluorenes.

Specific examples of phthalides are described, for example, in U.S. Pat. No. Re. 23,024, U.S. Pat. Nos. 3,491,111, 3,491,112, 3,491,116, and 3,509,174. Specific examples of fluorans are described, for example, in U.S. Pat. Nos. 3,624,107, 3,627,787, 3,641,011, 3,462,828, 3681,390, 3,920,510, and 3,959,571. Specific examples of spirodipyrans are described, for example, in U.S. Pat. No. 3,971,808. Specific examples of pyridines and pyrazines are described, for example, in U.S. Pat. Nos. 3,775,424, 3,853,869, and 4,246,318. Specific examples of fluorenes are described, for example, in Japanese Patent Application Laid-Open (JP-A) No. 63-94878.

The amount of electron donative colorless dyes of the present invention used for coating is not particularly limited. It is preferably 0.1–2.0 $g/m^2$, and particularly preferably 0.2–1.5 $g/m^2$.

Examples of electron accepting compounds used for preparing recording materials of the present invention include phenol derivatives, salicylic acid derivatives, metal salts of aromatic carboxylic acids, acidic terra alba, bentonite, novolak resins, metal-treated novolak resins, and metal complexes.

They are described, for example, in Japanese Patent Application Publication (JP-B) Nos. 40-9309 and 45-14039, Japanese Patent Application Laid-Open (JP-A) Nos. 52-140483, 48-51510, 57-210886, 58-87089, 59-11286, 60-176795, and 61-95988.

The content ratio of an electron donative colorless dye to an electron accepting compound is preferably between 1:10 and 1:1, particularly preferably between 1:5 and 2:3, on a weight basis.

The indolylazaphthalide compounds according to the present invention may be co-used together with conventionally known UV absorbers, brightening agents, and antioxidants.

Examples of preferred UV absorbers which may be co-used include benzophenones, benzotriazoles, salicylic acids cyanoacrylates, and oxalic acid anilides. They are described, for example, in Japanese Patent Application Laid-Open (JP-A) Nos. 47-10537, 58-111942, 58-212844, 59-19945, 59-46646, 59-109055, and 63-53544, Japanese Patent Application Publication (JP-B) Nos. 36-10466, 42-26187, 48-30492, 48-31255, 48-41572, 48-54965, and 50-10726, and U.S. Pat. Nos. 2,719,086, 3,707,375, 3,754, 919, and 4,220,711.

Examples of preferred brightening agents which may be co-used include coumarines. They are described, for example, in Japanese Patent Application Publication (JP-B) Nos. 45-4699 and 54-5324.

Examples of preferred antioxidants which may be co-used include hindered amines, hindered phenols, anilines, and quinolines. They are described, for example, in Japanese Patent Application Laid-Open (JP-A) Nos. 59-155090, 60-107383, 60-107384, 61-137770, 61-139481, and 61-160287.

The amounts of UV absorbers, brightening agents, or antioxidants are preferably 0.05–1.0 g/m$^2$, and particularly preferably 0.1–0.4 g/m$^2$.

In the case where the recording materials of the present invention are used for preparing pressure-sensitive papers, the resulting pressure-sensitive sheets may take various forms as described in U.S. Pat. Nos. 2,505,470, 2,505,471, 2,505,489, 2,548,366, 2,712,507, 2,730,456, 2,730,457, 3,103,404, 3,418,250, and 4,010,038. Most generally, they are formed of at least one pair of sheets, one sheet containing an electron donative colorless dye, and the other sheet containing an electron accepting compound.

When the indolylazaphthalides of the present invention are used as electron donative colorless dyes, they may be used while encapsulated in microcapsules.

Capsules may be prepared using numerous different methods, including methods described in U.S. Pat. Nos. 2,800,457 and 2,800,458 in which coacervation of hydrophilic colloidal sols is used; interfacial polymerization methods described, for example, in U.S. Pat. No. 3,287,154, U.K. Patent Nos. 867,797, 950,443, 989,264, 990,443, and 1,091, 076, Japanese Patent Application Publication (JP-B) Nos. 38-19574, 42-446, and 42-771; methods described in U.S. Pat. Nos. 3,418,250 and 3,660,304 which exploit precipitation of polymers; a method described in U.S. Pat. No. 3,418,250 in which wall materials of isocyanate polyols are used; a method described in U.S. Pat. No. 3,914,511 in which wall materials of isocyanates are used; methods described in U.S. Pat. Nos. 4,001,140, 4,087,376, and 4,089, 802 in which wall-forming materials such as hydroxypropylcellulose or melamin-formaldehyde resins are used, the melamin-formaldehyde resins being prepared using wall materials of urea-formaldehyde or urea-formaldehyde-resorcinols; methods described in Japanese Patent Application Publication (JP-B) No. 36-9168 and Japanese Patent Application Laid-Open (JP-A) No. 51-9079 in which monomers are polymerized in situ; electrolytic dispersion cooling methods described in U.K. Patent Nos. 952,807 and 965, 074; and spray-drying methods described in U.S. Pat. No. 3,111,407 and U.K. Patent No. 930,422. Preferred methods include, but are not limited to, a method in which a core substance is emulsified and then formed into a polymer film which serves as microcapsule wall materials.

According to the general practice, an electron donative colorless dye is dissolved in a solvent (synthetic oils such as alkylated naphthalene, alkylated diphenyl, alkylated phenylmethane, alkylated terphenyl, and chlorinated paraffin; vegetable oils such as cotton oil, and castor oil; animal oils; mineral oils; and mixtures of them), and the resultant solution is contained in microcapsules. The microcapsules are applied onto paper, free sheets, plastic sheets, resin-coated papers, etc. to obtain color former sheets.

Independently, an electron accepting compound is dispersed, alone or in combination with additives if desired, in a binder such as styrene-butadiene latex or polyvinyl alcohol. The resultant dispersion, together with a pigment, is applied onto a support such as paper, plastic sheets, or resin-coated papers to obtain developer sheets.

As binders, it is preferred, from the viewpoint of light fastness and waterproof properties, that carboxy-modified styrene-butadiene latex and a water-soluble polymer be co-used. The pigment is preferably calcium carbonate having an average particle size of 5.0 μm or less, which is preferably used in amounts of 60% by weight or more based on the total weight of the pigment.

The amounts of electron donative colorless dyes and electron accepting compounds vary depending on the desired thickness of the coat, form of pressure-sensitive recording papers, methods of manufacturing capsules, or other conditions, and therefore, they may be suitably selected accordingly. Persons having ordinary skill in the art can readily determine the amounts.

When heat-sensitive papers are produced, they may take the form as described in Japanese Patent Application Laid-Open (JP-A) Nos. 62-144,989 and 1-87291. Specifically, electron donative colorless dyes and electron accepting compounds are both used in a dispersed state after they are pulverized to have a grain size not greater than 10 μm, preferably not greater than 3 μm, in a dispersion medium and dispersed therein. A common dispersion medium is an aqueous solution of a water-soluble polymer at a concentration of around 0.5–10%. Dispersions are formed using ball mills, sand mills, transverse sand mills, attriters, and colloidal mills.

At this time, a heat-meltable substance may be contained in a heat-sensitive color forming layer. Typical examples of heat-meltable substances include aromatic ethers, thioether, esters, aliphatic amides, and ureidos.

They are described, for example, in Japanese Patent Application Laid-Open (JP-A) Nos. 58-57989, 58-87094, 61-58789, 62-109681, 62-132674, 63-151478, 63-235961, 2-184489, and 2-215585.

The heat-meltable substance may be finely dispersed together with either an electron donative colorless dye or an electron accepting compound. The amount of heat-meltable substance is between 20% and 300% by weight, particularly preferably between 40% and 150% by weight, with respect to the weight of the electron accepting compound.

Coating liquids obtained as prepared above may further contain additives if desired so as to meet various demands. Examples of additives include oil-absorptive substances such as inorganic pigments and polyurea fillers which are dispersed in a binder in order to prevent recording heads from get dirtied during recording; and fatty acids, metal soaps, etc. added so as to improve separability from heads. Accordingly, generally speaking, in addition to electron donative colorless dyes and electron accepting compounds, both of which directly contribute to development of colors, additives such as heat-meltable substances, pigments, waxes, antistatics, UV absorbers, defoamers, electroconducting agents, fluorescent dyes, and surfactants are applied onto a support, to thereby constitute recording materials. If desired, a protective layer may be provided on the surface of a heat-sensitive recording layer.

It is a usual practice that electron donative colorless dyes and electron accepting compounds are applied onto a support while dispersed in a binder. Water-soluble binders are commonly used. Examples of water-soluble binders include polyvinyl alcohol, hydroxyethylcellulose, hydroxypropylcellulose, epichlorohydrin-modified polyamides, ethylene-maleic anhydride copolymers, styrene-maleic anhydride copolymers, isobutylene-maleic anhydride copolymers, polyacrylic acid, polyacrylic amides, methylol-modified polyacrylic amides, starch derivatives, casein, and gelatin. For the purpose of obtaining waterproof properties, these binders may contain waterproofing agents or emulsions of hydrophobic polymers (such as styrene-butadiene rubber latex and acrylic resin emulsions), which may be preferably used in amounts of 0.4–5 g/m$^2$, particularly preferably 0.8–1.6 g/m$^2$.

The resultant heat-sensitive coating liquid is applied onto free sheets, free sheets having undercoat layers, synthetic papers, or plastic films. Considering dot reproductivity, it is recommended to use supports having a smoothness as defined by JIS-P8119 of not less than 500 seconds, and more preferably, not less than 800 seconds.

In the manufacture of recording materials according to the present invention, a variety of known additives including waxes, antistatics, defoamers, electroconducting materials, fluorescent dyes, surfactants, and UV absorbent precursors may be incorporated.

The recording material of the present invention may have a protective layer on the surface of its recording layer. The protective layer may be a laminate body in which two or more layers are superposed one on another. Materials which may be used for preparing protective layers include water-soluble polymers such as polyvinyl alcohols, carboxy-modified polyvinyl alcohols, vinyl acetate-acrylic amide copolymers, silicon-modified polyvinyl alcohols, starch, denatured starch, methylcellulose, carboxymethylcellulose, hydroxymethylcellulose, gelatins, gum arabic, casein, styrene-maleic acid copolymer hydrolysates, styrene-maleic acid copolymer half-ester hydrolysates, isobutylene-maleic acid copolymer hydrolysates, polyacrylic amides, polyvinylpyrrolidones, polystyrene sulfonic acid. Na, and sodium alginate; and latexes such as styrene-butadiene rubber latex, acrylonitrile-butadiene rubber latex, methyl acrylate-butadiene rubber latex, and vinyl acetate emulsions. When water-soluble polymers in the protective layer are cross-linked, storage stability is even more improved. In this case, known cross-linking agents may be used. Specific examples of cross-linking agents include water-soluble early stage condensates such as N-methylol urea, N-methylol melamin, urea-formalin; dialdehydes such as glyoxal, and glutaraldehyde; inorganic cross-linking agents such as boric acid and borax; and polyamide epichlorohydrin. The protective layer may also include other known substances such as pigments, metal soaps, waxes, and surfactants. The amount of the protective layer is preferably 0.2–5 g/m$^2$, and preferably 0.5–2 g/m$^2$. The thickness of the protective layer is preferably 0.2–5 μm, and particularly preferably 0.5–2 μm.

When a protective layer is provided in a recording material of the present invention, the protective layer may contain known UV absorbers or their precursors.

Examples of a support which may be used for preparing the recording material of the present invention include acid papers, neutral papers, coated papers, plastic film laminate papers, synthetic papers, and plastic films. The support may also be provided with a known undercoat layer. The undercoat layer may be formed like the aforementioned protective layer.

In order to correct the curl balance of a support or to improve chemical resistance on the back side of a support, a backcoat layer may be provided. The recording material of the present invention may take the form of a label in which a release paper is placed via an adhesive layer on the back side of the support.

The indolylazaphthalides of the present invention may be used for preparing a variety of recording materials described, for example, in U.S. Pat. Nos. 4,399,209, 4,551,407, 4,440,846, and 4,536,463, Japanese Patent Application Laid-Open (JP-A) No. 63-184738, 58-88739, 62-143044, 2-188293, 2-188294, 3-72358, 3-87827, 4-226455, 4-247985, 5-124360, and 5-294063.

The indolylazaphthalides of the present invention may be used for preparing heat-sensitive recording materials, particularly, multi-color heat-sensitive recording materials. Descriptions of multi-color heat-sensitive recording materials (light- and heat-sensitive recording materials) are found, for example, in Japanese Patent Application Laid-Open (JP-A) Nos. 4-135787, 4-144784, 4-144785, 4-194842, 4-247447, 4-247448, 4-340540, 4-340541, and 5-34860. Briefly, they can be prepared by laminating heat-sensitive recording layers which develop hues different from layer to layer. The structure of the layers is not particularly limited. Preferably, a heat-sensitive layer containing an electron donative colorless dye and an electron accepting compound is superposed on two heat-sensitive layers in which two diazonium salt compounds having different sensitization wavelengths are combined with couplers which develop different hues after reaction in the presence of heat, thereby forming a multi-color heat-sensitive recording material. Specifically, this embodiment comprises a support, and on the support, a first heat-sensitive recording layer containing an electron donative colorless dye and an electron accepting compound, a second heat-sensitive recording layer containing a diazonium salt compound having a maximum absorption wavelength of 360 nm±20 nm and a coupler reacting with the diazonium salt compound in the presence of heat to develop a color, and a third heat-sensitive recording layer containing a diazonium salt compound having a maximum absorption wavelength of 400 nm±20 nm and a coupler reacting with the diazonium salt compound in the presence of heat to develop a color. In this embodiment, when the hues which are to develop in respective heat-sensitive recording layers are selected in advance so as to realize the three primary colors in subtractive color mixing, i.e., yellow, magenta, and cyan, it is possible to record images with full colors.

In order to record images using the above-described multi-color heat-sensitive recording material, the third heat-sensitive recording layer is heated to cause a reaction of the diazonium salt and the coupler contained in this layer, thereby developing a color. Next, light having a wavelength of 400±20 nm is irradiated to decompose unreacted diazonium salt compound contained in the third heat-sensitive recording layer, after which heat sufficient for the second heat-sensitive recording layer to develop a color is applied to cause a reaction of the diazonium salt and the coupler contained in this layer, thereby developing a color. Although the third heat-sensitive recording layer is intensively heated simultaneously, no color generation occurs as the diazonium salt compound contained in this layer has already been decomposed and thus has no longer color generating ability. Subsequently, light having a wavelength of 360±20 nm is irradiated to decompose the diazonium salt compound contained in the second heat-sensitive recording layer. Lastly, heat sufficient for the first heat-sensitive recording layer to develop a color is applied to cause generation of a color. At this time, although the third and the second heat-sensitive recording layers are intensively heated simultaneously, no color generation occurs as the diazonium salt compound contained in these layers have already been decomposed and thus have no longer color generating ability.

When the recording material of the present invention takes the form of a multi-color heat-sensitive recording material, an intermediate layer may be provided so as to prevent color amalgamation of heat-sensitive recording layers. The intermediate layer may be formed of water-soluble polymers such as gelatin, phthalic gelatin, polyvinyl alcohol, and polyvinyl pyrrolidone. They may also contain a variety of additives. The amount of the intermediate layer to be applied is preferably 2–10 g/m$^2$, and more preferably 4–5 g/m$^2$. The thickness is preferably 0.5–10 μm.

EXAMPLES

The present invention will next be described by way of examples, which should not be construed as limiting the invention. Throughout the examples, % means % by weight unless otherwise indicated. The chemical structures of compounds were confirmed by $^1$H-NMR.

Example 1

N,N-di-n-Propyl-N'-acetyl-m-phenylenediamine (23.4 g) and (1-ethyl-2-methylindole-3-yl)(3-carboxypyridine-2-yl) ketone (30.8 g) were added to acetic anhydride (38 ml), and the mixture was stirred for 3–4 hours at 50°–55° C.

The reaction mixture was cooled to 10° C., and the precipitated crystals were subjected to filtration. The obtained crystals were recrystallized from ethyl acetate—ethanol, to obtain 36.7 g of compound I-1 of the present invention (compound I-1 represented by the aforementioned formula I-1, hereafter, similar shortened expressions are used).

The peak data of $^1$-NMR are shown below. The chemical shift data, δ values, are those with respect to the standard substance, TMS. In parentheses are shown the number of protons and the peak profiles identified by singlet, doublet, etc.

$^1$H-NMR ($CDCl_3$) δ (TMS, ppm) 0.92 (6H, t), 1.29 (3H, t), 1.59 (4H, qn), 2.28 (3H, s), 3.25 (4H, t), 4.08 (2H, qr), 6.00 (1H, d), 6.40 (1H, dd), 6.78 (1H, t), 7.05 (2H, m), 7.23 (1H, d), 7.44 (1H, d), 7.57 (1H, dd), 8.30 (1H, dd), 8.85 (1H, dd), 9.42 (1H, br-s)

Examples 2–6

The procedure of Example 1 was repeated, using various N,N-di-n-propyl-N'-acyl-m-phenylenediamines instead of N,N-di-n-propyl-N'-acetyl-m-phenylenediamine, thereby obtaining compounds I-3 (Example 2), I-4 (Example 3), I-6 (Example 4), 1-12 (Example 5), and 1-10 (Example 6), which all fall within the scope of the present invention. The results of $^1$H-NMR analyses performed on these compounds are shown below. From these results, the structure of each compound was identified.

(Example 2)

Compound I-3 of the present invention:

$^1$H-NMR ($CDCl_3$) δ (TMS, ppm) 0.61 (3H, d), 0.67 (3H, d), 0.92 (6H, t), 1.26 (3H, t) 1.61 (4H, qn), 1.89 (1H, m), 1.98 (3H, s) 3.25 (4H, t), 4.07 (2H, qr), 5.96 (1H, d) 6.39 (1H, dd), 6.78 (1H, t), 7.06 (1H, t) 7.19–7.30 (2H, m), 7.46 (1H, d) 7.58 (1H, dd), 8.33 (1H, dd), 8.85 (1H, dd), 9.53 (1H, br-s)

(Example 3)

Compound I-4 of the present invention:

$^1$H-NMR ($CDCl_3$) δ (TMS, ppm) 0.73 (9H, s), 0.92 (6H, t), 1.28 (3H, t), 1.63 (1H d), 1.61 (4H, qn), 1.94 (3H, s), 3.25 (4H t), 4.06 (2H, qr), 6.45 (1H, dd), 6.34 (1H t), 7.02 (1H, t), 7.21 (1H, d), 7.33 (1H dd), 7.47 (1H, d), 7.57 (1H, dd), 8.32 (1H dd), 8.81 (1H, dd), 9.70 (1H br-s)

(Example 4)

Compound I-6 of the present invention:

$^1$H-NMR ($CDCl_3$) δ (TMS, ppm) 0.87–0.95 (9H, m), 1.61 (4H, qn), 1.99 (3H, s), 3.24 (4H, t), 3.88 (2H, m), 5.78 (1H, d), 6.51 (1H, dd), 6.76 (1H, m), 6.91 (2H, m), 6.98 (2H, m), 7.21 (3H, m), 7.47 (1H, d), 7.53–7.62 (2H, m), 8.35 (1H, dd), 8.82 (1H, dd)

(Example 5)

Compound I-12 of the present invention:

$^1$H-NMR ($CDCl_3$) δ (TMS, ppm) 0.95 (6H, t), 1.63 (4H, qr), 1.98 (3H, s), 3.26 (4H, t), 3.90 (2H, m), 5.65 (1H, d), 6.46 (3H, m), 6.72 (1H, t), 6.95 (2H, m), 7.19 (1H, d), 7.32 (1H, d), 7.54–7.63 (2H, m), 8.36 (1H, dd), 8.66 (1H, d), 10.31 (1H, br-s)

(Example 6)

Compound I-10 of the present invention:

$^1$H-NMR (DMSO) δ (TMS, ppm) 0.89 (6H, t), 1.15 (3H, t), 1.56 (4H, qr), 1.81 (3H, t), 3.26 (4H, qr), 4.12 (2H, qr), 5.69 (1H, d), 6.62–6.73 (2H, m), 6.89 (1H, s), 7.00 (1H, t), 7.38 (1H, d), 7.49 (1H, d), 7.87 (1H, dd), 8.56 (1H, dd), 8.98 (1H, dd), 11.35 (1 H, b r-s)

Examples 7–10

The procedure of Example 1 was repeated, using various N,N-di-n-propyl-N'-acetyl-m-phenylenediamines instead of the N,N-di-n-propyl-N'-acetyl-m-phenylenediamine used in Example 1, thereby obtaining compounds Ia-1 (Example 7), Ia-2 (Example 8), Ia-3 (Example 9), and Ia-4 (Example 10), which all fall within the scope of the present invention. The results of $^1$H-NMR analyses performed on these compounds are shown below. From these results, the structure of each compound was identified.

(Example 7)

Compound Ia-1 of the present invention:

$^1$H-NMR ($CDCl_3$) δ (TMS, ppm) 0.76 (3H, t), 0.88 (6H, t), 1.02 (4H, m), 1.28 (3H, t), 1.54–1.66 (8H, m), 1.98 (3 H, s), 3.22 (4H, t), 4.06 (2H, qr), 5.99 (1H, d), 6.40 (1H, dd), 6.78 (1H, t), 7.05 (1H, t), 7.18 (1H, d), 7.23 (1H, d), 7.45 (1H, d), 7.56 (1H, dd), 8.30 (1H, dd), 8.85 (1H, dd), 9.48 (1H, br-s)

(Example 8)

Compound Ia-2 of the present invention:

$^1$H-NMR ($CDCl_3$) δ (TMS, ppm) 0.84–0.94 (12H, m), 1.20–1.32 (6H, m), 1.53–1.68 (10H, m), 1.98 (3H, t), 3.23 (4H t), 4.06 (2H qr), 6.00 (1H, d), 6.40 (1H, dd), 6.77 (1H t), 7.04 (1H, t), 7.18 (1H, d), 7.24 (1H d), 7.43 (1H, d), 7.57 (1H, dd), 8.20(1H dd), 8.85 (1H, dd), 9.47(1H br-s)

(Example 9)

Compound Ia-3 of the present invention:

$^1$H-NMR ($CDCl_3$) δ (TMS, ppm) 0.85–0.94 (12H, m), 1.19–1.30 (30H, m), 1.54 (6H, m), 1.99 (3H, s), 3.23 (4H, t), 4.06 (2H, qr), 5.99 (1H, d), 6.39 (1H, dd), 6.77 (1H, t), 7.04 (1H, t), 7.18 (1H, dd), 7.23 (1H, d), 7.44 (1H, d), 7.56 (1H, dd), 8.30 (1H, dd), 8.84 (1H, dd), 9.46 (1H, b r-s)

(Example 10)

Compound Ia-4 of the present invention:

$^1$H-NMR ($CDCl_3$) δ (TMS, ppm) 0.92 (6H, t), 1.09 (3H, t), 1.56 (3H, s), 1.61 (4H, qr), 1.90 (3H, s), 3.24 (4H, t), 3.94 (2H, qr), 4.00 (1H, s), 5.75 (1H, d), 6.41 (1H, dd), 6.74–6.78 (2H, m), 6.85 (1H, t), 6.89–6.94 (2H, m), 7.09–7.22 (8H, m), 7.30 (1H, d), 7.44–7.50 (2H, m), 8.25 (1H, dd), 8.38 (1H, dd), 9.98 (1H, br-s)

Example 11

The procedure of Example 1 was repeated, using (1-n-octyl-2-methylindole-3-yl)(3-carboxypyridine-2-yl)ketone instead of (1-ethyl-2-methylindole-3-yl)(3-carboxypyridine-2-yl)ketone, thereby obtaining compound 1-15 of the present invention. The results of $^1$H-NMR analysis are shown below. From these results, the structure of this compound was identified.

(Example 11)

Compound 1–15 of the present invention:

$^1$H-NMR ($CDCl_3$) δ (TMS, ppm) 0.99 (9H, m), 1.22–1.27 (12H, m), 1.58 (3H, s), 1.61 (4H, m), 2.00 (3H, s), 3.22 (4H, m), 3.98 (2H, t), 6.00 (1H, d), 6.40 (1H, dd), 6.78 (1H, t), 7.05 (2H, m), 7.23 (1H, d), 7.44 (1H, d), 7.57 (1H, dd), 8.30 (1H, dd), 8.85 (1H, dd), 9.42 (1H, br-s)

Example 12

The procedure of Example 1 was repeated, using (1-n-pentyl-2-methylindole-3-yl)(3-carboxypyridine-2-yl)ketone instead of (1-ethyl-2-methylindole-3-yl)(3-carboxypyridine-2-yl)ketone, thereby obtaining compound Ia-7 (Example 12) of the present invention. The results of $^1$H-NMR analysis are shown below. From these results, the structure of this compound was identified.

(Example 12)

Compound Ia-7 of the present invention:

$^1$H-NMR ($CDCl_3$) δ (TMS, ppm) 0.86–0.93 (9H, m), 1.28 (3H, s), 1.36 (4H, m), 1.55–1.70 (6H, m), 2.00 (3H, s), 3.23 (4H, m), 3.98 (2H, t), 6.02 (1H, d), 6.39 (1H, dd), 6.78 (1H, t), 7.06 (1H, t), 7.07 (1H, dd), 7.24 (1H, d), 7.44 (1H, d), 7.56 (1H, dd), 8.30 (1H, dd), 8.88 (1H, dd), 9.41 (1H, br-s)

Example 13

The procedure of Example 1 was repeated, using (1-isobutyl-2-methylindole-3-yl)(3-carboxypyridine-2-yl) ketone instead of (1-ethyl-2-methylindole-3-yl)(3-carboxypyridine-2-yl)ketone, thereby obtaining compound Ia-8 (Example 13) of the present invention. The results of $^1$H-NMR analysis are shown below. From these results, the structure of this compound was identified.

(Example 13)

Compound Ia-8 of the present invention:

$^1$H-NMR ($CDCl_3$) δ (TMS, ppm) 1.08–1.17 (12H, m), 1.56 (3H, s), 1.77–1.89 (4H, m), 2.02 (3H, s), 2.28–2.38 (1H, m), 3.46 (4H, t), 4.04 (2H, d), 6.34 (1H, d), 6.61 (1H, dd), 7.01 (1H, t), 7.26 (1H, t), 7.37 (1H, d), 7.46 (1H, d), 7.64 (1H, d), 7.78 (1H, dd), 8.51 (1H, dd), 9.07 (1H, dd), 9.66 (1H, br-s)

Examples 14–21

The procedure of Example 1 was repeated, using (1-n-octyl-2-methylindole-3-yl)(3-carboxypyridine-2-yl)ketone instead of (1-ethyl-2-methylindole-3-yl)(3-carboxypyridine-2-yl)ketone, thereby obtaining compounds Ia-9 (Example 14), Ia-10 (Example 15), Ia-11 (Example 16), Ia-12 (Example 17), Ia-13 (Example 18), Ia-14 (Example 19), Ia-15 (Example 20), and Ia-16 (Example 21), which all fall within the scope of the present invention. The results of $^1$H-NMR analyses performed on these compounds are shown below. From these results, the structure of each compound was identified.

(Example 14)

Compound Ia-9 of the present invention:

$^1$H-NMR ($CDCl_3$) δ (TMS, ppm) 0.50 (3H, t), 0.84–0.95 (9H, t), 1.01–1.14 (2H, m), 1.20–1.37 (10H, m), 1.43–1.57 (2H, m), 1.57–1.70 (6H, m), 1.98 (3H, s), 3.24 (4H, t), 3.96 (2H, t), 6.07 (1H, d), 6.48 (1H, dd), 6.79 (1H, t), 7.05 (1 H, t) , 7.21 (1H, d), 7.25 (1H, d), 7.42 (1H, d), 7.56 (1H, dd), 8.29 (1H, dd), 8.84 (1H, dd), 9.42 (1H, br-s)

(Example 15)

Compound Ia-10 of the present invention:

$^1$H-NMR ($CDCl_3$) δ (TMS, ppm) 0.61 (3H, t), 0.81–0.94 (9H, m), 1.20–1.38 (12H, m), 1.45–1.70 (10H, m), 1.98 (3 H, s), 3.23 (4 H, t), 3.95 (2 H, t), 6.03 (1H, d), 6.38 (1H, dd), 6.76 (1H, t), 7.04 (1H, t), 7.19–7.24 (2H, m), 7.43 (1H, d), 7.56 (1H, dd), 8.28 (1H, dd), 8.81 (1 H, dd), 9.46 (1 H, b r-s)

(Example 16)

Compound Ia-11 of the present invention:

$^1$H-NMR ($CDCl_3$) δ (TMS, ppm) 0.50 (3H, d) , 0.58 (3H, d), 0.84–0.93 (9H, m), 1.22–1.36 (8H, m), 1.43 (1H, m), 1.50–1.68 (10H, m), 2.00 (3H, s), 3.23 (4H, t), 3.94 (2H, t), 6.15 (1H, dd), 6.37 (1H, dd), 6.80 (1H, t), 7.06 (1H, t), 7.20 (1H, d), 7.36 (1H, d), 7.42 (1H, d), 7.55 (1H, dd), 8.29 (1H, dd), 8.85 (1H, dd), 9.42 (1H. br-s)

(Example 17)

Compound Ia-12 of the present invention:

$^1$H-NMR ($CDCl_3$) δ (TMS, ppm) 0.60 (3H, d), 0.68 (3H, d), 0.84–0.93 (9H, m), 1.23–1.35 (10H, m), 1.55–1.68 (7H, m), 1.87 (1H, qr), 1.96 (3H, s), 3.23 (4H, t), 3.95 (2H, t), 6.01 (1H, d), 6.38 (1H, dd), 6.76 (1H, t), 7.03 (1H, t), 7.20

(1H, d), 7.32 (1H, d), 7.43 (1H, d), 7.55 (1H, dd), 8.30 (1H, dd), 8.82 (1H, d), 9.51 (1H, br-s)

(Example 18)

Compound Ia-13 of the present invention:

$^1$H-NMR ($CDCl_3$) δ (TMS, ppm) 0.72 (9H, s), 0.85–0.93 (9H, m), 1.24–1.86 (10H, m). 1.59–1.69 (6H, m), 1.93 (8H, s), 3.24 (4H, t), 3.93 (2H, t), 5.85 (1H, m), 6.40 (1H. dd), 6.72 (1H, t), 7.01 (1H. t), 7.18 (1H, d), 7.30 (1H, dd), 7.43 (1H, d), 7.56 (1H, dd), 8.30 (1H, dd), 8.81 (1H. dd), 9.61 (1H, br-s)

(Example 19)

Compound Ia-14 of the present invention:

$^1$H-NMR ($CDCl_3$) δ (TMS, ppm) 0.87 (3H, t), 0.93 (6H, t), 1.08–1.35 (12H, m), 1.57–1.68 (4H, m), 1.98 (3H, s), 3.24–3.30 (4H, m), 3.74–3.82 (2H, m), 5.84 (1H, d), 6.46 (1H, dd), 6.71–6.79 (1H, m), 6.90 (2H, t), 6.97 (2H, m), 7.17–7.23 (3H, m), 7.48–7.52 (2H, m), 7.57 (1H, dd), 8.32 (1H, dd), 8.80 (1H, dd), 10.21 (1H, br-s)

(Example 20)

Compound Ia-15 of the present invention:

$^1$H-NMR ($CDCl_3$) δ (TMS, ppm) 0.85–0.93 (9H, m), 1.24–1.37 (10H, m), 1.53–1.68 (6H, m), 1.93 (3H, s), 2.68 (1H, d), 3.14 (1H, d), 3.22 (4H, t), 3.96 (2H, t), 5.63 (1H, d), 6.41 (1H, dd), 6.53 (2H, d), 6.79 (1H, t), 7.02–7.18 (5H, m), 7.28 (1H, d), 7.43–7.49 (2H, m) , 8.23 (1H, dd), 8.34 (1H, dd), 9.53 (1H, b r-s)

(Example 21)

Compound Ia-16 of the present invention:

$^1$H-NMR ($CDCl_3$) δ (TMS, ppm) 0.83–0.95 (9H, m), 1.19–1.31 (10H, m), 1.55–1.68 (6H, m), 1.95 (3H, s), 3.25 (4H, t), 3.57 (1H, d), 3.91 (2H, t), 4.03 (1H, d), 5.95 (1H, d), 6.39–6.47. (3H, m). 6.58 (1H, t), 6.90 (2H, t), 7.10–7.18 (4H, m), 7.47–7.54 (2H, m), 8.26 (1H, dd), 8.69 (1H, dd), 10.36 (1H, br-s)

Example 22

The procedure of Example 1 was repeated, using (1-ethyl-2-phenylindole-3-yl)(3-carboxypyridine-2-yl)ketone instead of (1-ethyl-2-methylindole-3-yl)(3-carboxypyridine-2-yl)ketone, thereby obtaining compound 1-21 (Example 22) of the present invention. The results of $^1$H-NMR analysis are shown below. From these results, the structure of this compound was identified.

(Example 22)

Compound I-21 of the present invention:

$^1$H-NMR ($CDCl_3$ ) δ (TMS, ppm) 0.91 (6H, t), 1.17 (3H, t), 1.39 (3H, s), 1.48–1.54 (4H, m), 3.16 (4H, t), 3.73–3.89 (2H, m), 5.89 (1H, dd), 6.04 (1H, d), 6.8 6 (1 H, t), 6.96–7.08 (4H, m), 7.10–7.29 (4H, m), 7.32(1H, d), 7.46 (1H, dd), 8.17 (1H, dd), 8.76 (1H, dd) , 10.03(1H, br-s)

Example 23

1) Preparation of a capsulated liquid containing an electron donative colorless dye An electron donative colorless dye (Compound I-1 of the present invention) (3.0 parts) was dissolved in ethyl acetate (20 parts). To the solution, a high-boiling point solvent, alkylnaphthalene (KMC-210, product of Kureha Chemical Industry Co., Ltd.) (20 parts), was added and mixed to obtain a uniform mixture. To the resultant mixture, a 3/1 adduct of xylylene diisocyanate/trimethylolpropane (75 wt. % ethyl acetate solution) (Takenate D-110N, product of Takeda Chemical Industries, Ltd.) (20 parts) was added and mixed to obtain a uniform mixture.

Separately, to 54 parts of a 6% aqueous solution of a polyvinyl alcohol (polymerization degree: 1700, saponification degree: 88%), the above-described electron donative colorless dye was added, followed by emulsifying and dispersing using a homogenizer. The resultant emulsion was combined with water (68 parts) and homogenized, after which the temperature of the homogenized mixture was elevated to 50° C. A capsulating reaction was allowed to proceed for 3 hours to obtain a target capsulated liquid. The average particle size of the capsules was 1.6 μm.

2) Preparation of a dispersion liquid of an electron accepting compound

As an electron accepting compound, bisphenol A (30 parts) was added to a 4% aqueous polyvinyl alcohol solution (150 parts). The mixture was dispersed for 24 hours using a ball mill to prepare a dispersion liquid. The average particle size of the electron accepting compound present in the resultant dispersion liquid was 1.2 μm.

3) Preparation of a paper coated with a coating liquid and image recording

The thus-obtained capsulated liquid containing an electron donative colorless dye and the dispersion liquid of an electron accepting compound were mixed so that the molar ratio of electron donative colorless dye/electron accepting compound was 1/15, thereby obtaining a target coating liquid.

Onto a polyethylene terephthalate support having a thickness of 75 μm, the above-mentioned coating liquid was applied using a Mayor's bar and dried to obtain a target heat-sensitive recording material.

Color was developed using a printing tester manufactured by Kyocera Corporation. Images having a cyan color were obtained.

4) Testing of light fastness of non-image area

Light was irradiated, using a xenon fade meter (model FAL-25AX-HC, manufactured by Suga Shikenki), for 48 hours onto a non-image area which did not contain any printed character. The yellow density of the non-image area before undergoing irradiation ($Y_0$) and the yellow density of the non-image area after undergoing irradiation ($Y_1$) were measured using a Macbeth's densitometer. Light fastness of the non-image area was shown by way of the increment of yellow density, i.e., $(\Delta OD_y)-(Y_1-Y_0)$, as a yardstick. The smaller the $\Delta OD_y$, the more excellent the light fastness of the non-image area.

Examples 24–44

The procedure of Example 23 was repeated, replacing the electron donative colorless dye (compound I-1 of the present invention) used in Example 23 by compound I-3 of the present invention, (thus, a heat-sensitive recording material obtained by the use of the electron donative colorless dye in Example 2 corresponds to Example 24, with the same rule being applied to the subsequent examples), compound I-4 of the present invention (Example 25), compound I-6 of the present invention (Example 26), compound I-12 of the present invention (Example 27), compound I-10 of the present invention (Example 28), compound I-15 of the present invention (Example 29), compound Ia-1 of the present invention (Example 30), compound Ia-2 of the present invention (Example 31), compound Ia-3 of the present invention (Example 32), compound Ia-4 of the present invention (Example 33), compound Ia-7 of the present invention (Example 34), compound Ia-8 of the present invention (Example 35), compound Ia-9 of the present invention (Example 36), compound Ia-10 of the present invention (Example 37), compound Ia-11 of the present invention (Example 38), compound Ia-12 of the present invention (Example 39), compound Ia-13 of the present invention (Example 40), compound Ia-14 of the present invention (Example 41), compound Ia-15 of the present invention (Example 41), compound Ia-16 of the present invention (Example 43), or compound I-21 of the present invention (Example 44), thereby obtaining heat-sensitive recording papers. In a manner similar to that described in Example 23, qualities of recorded images and those of non-image areas of the recording papers were assessed.

Comparative Examples 1–4

The procedure of Example 23 was repeated, replacing the electron donative colorless dye (compound I-1 of the present invention) used in Example 23 by comparative compound A-1 (Comparative Example 1), comparative compound A-2 (Comparative Example 2), comparative compound A-3 (Comparative Example 3), or comparative compound A-4 (Comparative Example 4), thereby obtaining heat-sensitive recording papers. In a manner similar to that described in Example 23, qualities of recorded images and those of non-image area of the recording papers were assessed.

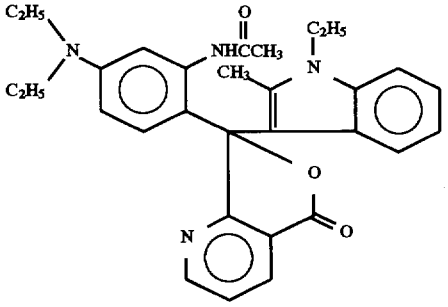

A-1

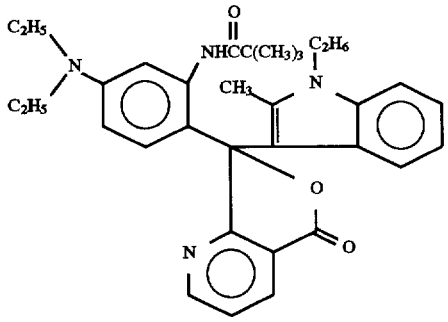

A-2

-continued

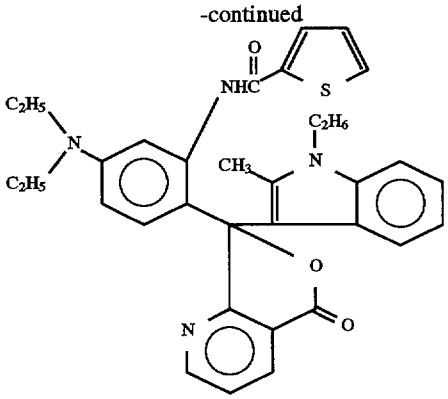

A-3

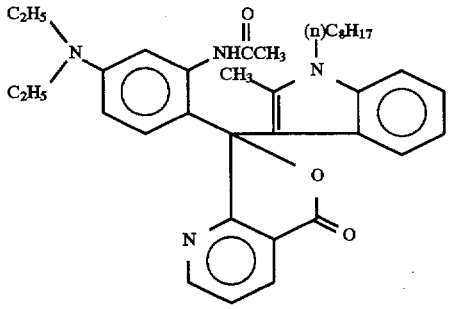

A-4

Examples 45–50

The procedure of Example 23 was repeated, replacing the electron accepting compound, bisphenol A used in Example 23 by 4,4'-cyclohexylidene phenol (Example 45), 4,4'-dihydroxydiphenyl sulfide (Example 46), 4,4'-dihydroxydiphenyl ether (Example 47), 4-hydroxyphenyl-4'-isopropoxyphenyl sulfone (Example 48), α,α'-bis(3,5-dihydroxyphenylcarbonyloxy)-p-xylene (Example 49), or 1,3,3,5-tetra(4-hydroxyphenyl)pentane (Example 50), thereby obtaining heat-sensitive recording papers. In a manner similar to that described in Example 23, qualities of recorded images and those of non-image area of the recording papers were assessed.

Comparative Examples 5–10

The procedures of Examples 45–50 were repeated, replacing the electron donative colorless dye (compound I-1 of the present invention) used in these Examples by comparative compound A-1, thereby obtaining heat-sensitive recording papers. In a manner similar to that described in Example 23, qualities of recorded images and those of non-image area of the recording papers were assessed.

The results of Examples 23–50 as well as those of Comparative Examples 1–10 are shown in Tables 4 and 5.

TABLE 4

| | Light fastness of non-image area |
|---|---|
| Example 23 | 0.12 |
| Example 24 | 0.12 |
| Example 25 | 0.10 |
| Example 26 | 0.11 |
| Example 27 | 0.12 |
| Example 28 | 0.10 |
| Example 29 | 0.11 |
| Example 30 | 0.11 |
| Example 31 | 0.11 |

TABLE 4-continued

| | Light fastness of non-image area |
|---|---|
| Example 32 | 0.08 |
| Example 33 | 0.13 |
| Example 34 | 0.12 |
| Example 35 | 0.11 |
| Example 36 | 0.09 |
| Example 37 | 0.11 |
| Example 38 | 0.09 |
| Example 39 | 0.11 |
| Example 40 | 0.08 |
| Example 41 | 0.12 |
| Example 42 | 0.13 |
| Example 43 | 0.11 |
| Example 44 | 0.12 |
| Comp. Ex. 1 | 0.19 |
| Comp. Ex. 2 | 0.18 |
| Comp. Ex. 3 | 0.20 |
| Comp. Ex. 4 | 0.18 |

TABLE 5

| | Light fastness of non-image area |
|---|---|
| Example 45 | 0.12 |
| Comp. Ex. 5 | 0.19 |
| Example 46 | 0.10 |
| Comp. Ex. 6 | 0.17 |
| Example 47 | 0.11 |
| Comp. Ex. 7 | 0.19 |
| Example 48 | 0.11 |
| Comp. Ex. 8 | 0.17 |
| Example 49 | 0.11 |
| Comp. Ex. 9 | 0.18 |
| Example 50 | 0.10 |
| Comp. Ex. 10 | 0.17 |

As is apparent from Tables 4 and 5, the heat-sensitive recording materials of the present invention incorporating the indolylazaphthalides of the present invention caused reduced yellowing in non-image areas and exhibited excellent light fastness in non-image areas as compared with comparative products. Their excellent effects were quite irrespective of the structures of the indolylazaphthalides employed as well as those of co-used electron accepting compounds.

Example 51

Next will be described examples of multi-layered multicolor heat-sensitive recording materials prepared according to the present invention, which are capable of independently recording three colors of yellow, magenta, and cyan as well as reproducing full-color images.

(1) Preparation of a coating liquid for forming a cyan heat-sensitive color forming layer (layer A) (Preparation of a capsulated liquid containing an electron donative colorless dye)

1. Layer A-1

The indolylazaphthalide (3 parts) prepared in Example 1 (compound I-1 of the present invention) was dissolved in ethyl acetate (20 parts). Alkylnaphthalene (a high boiling point solvent, 20 parts) was added to the solution, followed by heating and mixing to obtain a uniform mixture.

To the resultant solution, a 1:3 adduct of xylylene diisocyanate/trimethylolpropane (Takenate D-110N, trademark, product of Takeda Chemical Industries, Ltd.) (20 parts) was added and mixed to obtain a uniform liquid containing the electron donative colorless dye.

2. Layer A-2

The thus-prepared liquid containing an electron donative colorless dye was added to a liquid prepared by combining 54 parts of a 6% aqueous phthalic gelatin solution and 2 parts of a 2% by weight aqueous solution of sodium dodecylsulfonate, and the mixture was emulsified and dispersed using a homogenizer, thereby obtaining an emulsion. The resultant emulsion was combined with water (68 parts) and homogenized by mixing, after which the temperature of the homogenized mixture was elevated to 50° C. A capsulating reaction was allowed to proceed for 3 hours to obtain a target capsulated liquid in which the average particle size of the capsules was 1.6 μm.

(Preparation of a dispersion liquid of an electron accepting compound)

An electron accepting compound, bisphenol P, used in Example 1 was added to a 4% aqueous polyvinyl alcohol solution (150 parts). The mixture was dispersed for 24 hours using a ball mill to prepare a dispersion liquid. The resultant dispersion was poured into a solution prepared by combining a 15% aqueous solution (45 parts) of phthalic gelatin and a 10% aqueous sodium dodecylsulfonate solution (5 parts), emulsified for 10 minutes using a homogenizer, thereby obtaining a dispersion liquid.

(Preparation of a coating liquid)

The thus-obtained capsulated liquid containing an electron donative colorless dye and the dispersion liquid of an electron accepting compound were mixed so that the ratio of the liquid to the dispersion was 1/4, thereby obtaining a coating liquid.

(2) Preparation of a coating liquid for forming a magenta heat-sensitive color forming layer (layer B)

(Preparation of a capsulated liquid containing a diazo compound)

4-N-(2-(2,4-di-tert-Amylphenoxy)butyryl piperazinobenzene diazonium hexafluorophosphate (a diazo compound, decomposed by light having a wavelength of 365 nm) (2.0 parts) was dissolved in ethyl acetate (20 parts). Alkylnaphthalene (20 parts) was added to the solution, followed by heating and mixing to obtain a uniform mixture. To the resultant solution, Takenate D-110N (capsule wall agent) (15 parts) was added and uniformly mixed to obtain a solution containing the diazo compound.

The thus-prepared solution of a diazo compound was added to a solution prepared by combining 54 parts of a 6% aqueous solution of polyvinyl alcohol (polymerization degree: 1700, saponification degree: 88%) and 2 parts of a 2% aqueous sodium dodecylsulfonate solution, and the mixture was emulsified and dispersed using a homogenizer.

The resultant emulsion was combined with water (68 parts) and homogenized by mixing, after which the temperature of the homogenized mixture was elevated to 40° C. A capsulating reaction was allowed to proceed for 3 hours to obtain a capsulated liquid in which the average particle size of the capsules was 1.1 μm.

(Preparation of a dispersion liquid of a coupler)

1-Phenyl-3-(2,5-di-n-octyloxyphenyl)barbituric acid (2 parts), 1,2,3-triphenylguanidine (2 parts), tricresylphosphate (0.3 part), and diethyl maleate (0.1 part) were dissolved in ethyl acetate (10 parts). The resultant solution was poured into an aqueous solution prepared by mixing a 6% aqueous gelatin solution (50 g) and a 2% aqueous sodium dodecylsulfonate solution (2 g), emulsified for 10 minutes using a homogenizer, thereby obtaining a dispersion liquid.

(Preparation of a coating liquid)

The thus-obtained capsulated liquid containing a diazo compound and the dispersion liquid of a coupler were mixed so that the weight ratio of the liquid to the dispersion was 2/3, thereby obtaining a coating liquid.

(3) Preparation of a coating liquid for forming a yellow heat-sensitive color forming layer (layer C)

(Preparation of a capsulated liquid containing a diazo compound)

2,5-Dibutoxy-4-tolylthiobenzene diazonium hexafluorophosphate (a diazo compound, decomposed by light having a wavelength of 420 nm) (3.0 parts) was dissolved in ethyl acetate (20 parts). A high boiling point solvent, alkylnaphthalene (20 parts), was added to the solution, followed by heating and mixing to obtain a uniform mixture. To the resultant solution, Takenate D-110N (15 parts) was added and uniformly mixed to obtain a solution containing the diazo compound.

The thus-prepared solution of a diazo compound was added to a solution prepared by combining 54 parts of a 6% aqueous solution of phthalic gelatin and 2 parts of an aqueous solution of sodium dodecylsulfonate, and the mixture was emulsified and dispersed using a homogenizer. The resultant emulsion was combined with water (68 parts) and homogenized by mixing, after which the temperature of the homogenized mixture was elevated to 40° C. A capsulating reaction was allowed to proceed for 3 hours to obtain a capsulated liquid in which the average particle size of the capsules was 1.3 μm.

(Preparation of a dispersion liquid of a coupler)

2-Chloro-5-(3-(2,4-di-tert-pentyl)phenoxypropylamino)-acetanilide barbituric acid (2 parts), 1,2,3-triphenylguanidine (1 part), tricresylphosphate (0.3 part), and diethyl maleate (0.1 part) were dissolved in ethyl acetate (10 parts). The resultant solution was poured into an aqueous solution prepared by mixing a 6% aqueous gelatin solution (50 g) and a 2% aqueous sodium dodecylsulfonate solution (2 g), emulsified for 10 minutes using a homogenizer, thereby obtaining a dispersion liquid.

(Preparation of a coating liquid)

The thus-obtained capsulated liquid containing a diazo compound and the dispersion liquid of a coupler were mixed so that the weight ratio of the liquid to the dispersion was 2/3, thereby obtaining a coating liquid.

(4) Preparation of a coating liquid for forming an intermediate layer

Hollow capsules (Lowpake OP-62, trademark, product of Rohm & Haas) (2.4 g) were added to an aqueous gelatin solution (24%, #750, trademark, product of Nitta Gelatin K.K.) (10 g), followed by mixing to obtain a uniform mixture, thereby obtaining a coating liquid for forming an intermediate layer.

(5) Preparation of a coating liquid for forming a protective layer

A dispersion liquid (15 g) containing 40% zinc stearate (Hidrin Z, trademark, product of Chukyo Yushi K.K.) was added to a liquid prepared by mixing a 6% aqueous solution (100 g) of itaconic acid-modified polyvinyl alcohol (KL-318, trademark, product of Kuraray Co., Ltd.) and a dispersion (10 g) of 30% epoxy-modified polyamide (FL-71, trademark, product of Toho Chemical Industry Co., Ltd.), thereby obtaining a coating liquid for forming a protective layer.

A coating liquid for forming a backing layer

A 4% aqueous gelatin solution (1200 g) was used as a coating liquid for forming a backing layer.

Preparation of support having undercoat layers

Onto both surfaces of a polyethyleneterephthalate film having a thickness of 175 μm, SBR latex was applied in amounts of 0.3 g/m$^2$ reduced to a solid basis. Thereafter, the below-described coating liquid for forming an undercoat layer was applied onto both surfaces in amounts of 0.1 g per m$^2$ of a surface reduced to a solid basis, thereby obtaining support having undercoat layers.

Preparation of a coating liquid for forming an undercoat layer

A 5% aqueous gelatin solution (#810, product of Nitta Gelatin K.K.) (200 g), a gelatin dispersion (0.5 g) prepared by dispersing in gelatin 5% by amount of polymethylmethacrylate resin particles having a particle size of 2 μm, a 3% aqueous 1,2-benzothiazoline-3-one solution (1.0 g), and a 2% aqueous di(2-ethyl)hexyl sulfonate solution (10 g) were mixed to obtain a coating liquid for forming an undercoat layer.

(6) Preparation of a multi-color heat-sensitive recording material

Onto one surface of a transparent support provided with an undercoat layer prepared in advance, a coating liquid for forming a backing layer was applied in amounts of 1.8 g/m$^2$ reduced to a solid basis and dried (the thickness after drying being 10 μm).

Subsequently, the other surface was sequentially coated with a liquid for forming a cyan heat-sensitive color forming layer, a liquid for forming an intermediate layer, a liquid for forming a magenta heat-sensitive color forming layer, a liquid for forming an intermediate layer, a liquid for forming a yellow heat-sensitive color forming layer, and a liquid for forming a protective layer, in this order from the support. Coating operations were performed on a slide of a slide-type hopper bead coater. After coating, the multilayered structure was dried to obtain a multi-color heat-sensitive recording material.

The amount of each liquid used for coating was as follows (reduced to a solid basis after drying): Cyan heat-sensitive recording layer: 6.1 g/m$^2$, magenta heat-sensitive recording layer: 7.8 g/m$^2$, intermediate layer (gelatin: 1.2 g/m$^2$, hollow capsules: 1.2 g/m$^2$): 2.4 g/m$^2$, yellow heat-sensitive recording layer: 7.2 g/m$^2$, and protective layer: 2.0 g/m$^2$.

(7) Thermal recording

Using the thus-obtained recording material, recording was performed as follows.

Yellow images were recorded on recording materials using a thermal head model KST (trademark, product of Kyocera Corporation) while controlling a recording thermal energy per unit area by adjusting applying voltage and pulse width so that the density of the images measured using a Macbeth's densitometer was 0.5.

Subsequently, the images were exposed to light of an UV lamp (central wave length of emission: 420 nm, power: 40 W) for 10 seconds, thereby photochemically fixing the yellow heat-sensitive color forming layer. Thereafter, recording thermal energy of a thermal head was controlled by adjusting the applying voltage and pulse width, and magenta images were recorded so that the density of the images measured using a Macbeth's densitometer was 0.5.

Subsequently, the images were exposed to light of an UV Lamp (central wave length of emission: 365 nm, power: 40 W) for 30 seconds, thereby photochemically fixing the magenta heat-sensitive color forming Layer. Thereafter, recording thermal energy of a thermal head was controlled by adjusting the applying voltage and pulse width, and cyan images were recorded so that the density of the images measured using a Macbeth's densitometer was 0.5.

As a result, in addition to images having yellow, magenta, and cyan developing independently, image portions recorded with yellow and magenta in a superposing fashion developed a red color, portions recorded with magenta and cyan in a superposing fashion developed a blue color, portions recorded with yellow and cyan in a superposing fashion developed a green color, and the portions recorded with yellow, magenta, and cyan in a superposing fashion developed a black color.

Example 52

The procedure of Example 51 was repeated using a compound 1–15 of the present invention instead of the electron donative colorless dye (compound I-1 of the present invention) used in Example 51, thereby obtaining a full-color multi-layered multi-color heat-sensitive recording material.

Using this recording material, light fastness of non-image areas was tested in a manner similar to that described in Example 23.

Examples 53–55

The procedure of Example 51 was repeated replacing the electron accepting compound, bisphenol P, by α,α'-bis(3,5-dihydroxyphenylcarbonyloxy)-p-xylene (Example 53), 1,3,3,5-tetra(4-hydroxyphenyl)pentane (Example 54), or 4,4'-dihydroxy-3,3'-dimethyldiphenyl sulfone (Example 55), thereby obtaining a full-color multi-layered multi-color heat-sensitive recording material.

Comparative Examples 11–15

The procedure of Example 51 was repeated replacing the compound I-1 of the present invention used in each of Examples 51 and 53–55 by a compound A-1, thereby obtaining a full-color multi-layered multi-color heat-sensitive recording material.

Moreover, the procedure of Comparative Example 12 was repeated replacing the compound I-7 of the present invention used in Example 52 by a compound A-4, thereby obtaining a full-color multi-layered multi-color heat-sensitive recording material.

Using each of the recording materials, qualities of recorded images and those of non-image areas of the recording papers were assessed.

The results of Examples 51–55 and Comparative Examples 11–15 are shown in Table 6 below.

TABLE 6

| | Light fastness of non-image area |
|---|---|
| Example 51 | 0.22 |
| Comp. Ex. 11 | 0.29 |
| Example 52 | 0.21 |
| Comp. Ex. 12 | 0.28 |
| Example 53 | 0.21 |
| Comp. Ex. 13 | 0.28 |
| Example 54 | 0.20 |
| Comp. Ex. 14 | 0.27 |
| Example 55 | 0.20 |
| Comp. Ex. 15 | 0.27 |

As is apparent from Table 6, the multi-layered multi-color heat-sensitive recording materials incorporating the indolylazaphthalides of the present invention as electron donative colorless dyes caused reduced yellowing and exhibited excellent light fastness in non-image areas compared with products incorporating conventional electron donative colorless dyes.

As described above, the novel indolylazaphthalides of the present invention are useful as electron donative colorless dyes for preparing recording materials, and recording materials incorporating the compounds provide images having blue to cyan colors at an excellent density, while suppressing light coloration in non-image areas.

What is claimed is:

1. A recording material formed of a substrate having thereon an electron donative colorless dye and an electron accepting compound, comprising at least one indolylazaphthalide represented by the following formula (I) as the electron donative colorless dye:

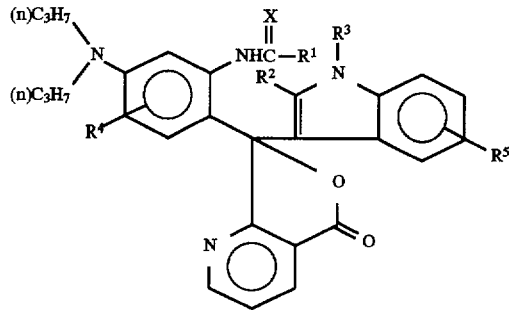

(I)

wherein $R^1$ represents an alkyl group, a cycloalkyl group, an aralkyl group, an aryl group, or a heterocyclic group; each of $R^2$ and $R^3$ represents a hydrogen atom, an alkyl group, or an aryl group; each of $R^4$ and $R^5$ represents a hydrogen atom, an alkyl group, an alkoxy group, or a halogen atom; and X represents an oxygen atom or a sulfur atom.

2. The recording material according to claim 1, wherein the amount of the indolylazaphthalide represented by formula (I) used for coating is 0.1–2.0 g/m$^2$.

3. The recording material according to claim 1, wherein the electron accepting compound is selected from the group consisting of phenol derivatives, salicylic acid derivatives, metal salts of aromatic carboxylic acids, acidic terra alba, bentonite, novolak resins, metal-treated novolak resins, and metal complexes.

4. The recording material according to claim 1, wherein the ratio of the electron donative colorless dye to the electron accepting compound is from 1:10 to 1:1 on a weight basis.

5. The recording material according to claim 1, wherein indolylazaphthalide is co-used in combination with a UV absorber, a brightening agent, or an antioxidant.

6. The recording material according to claim 1, wherein the indolylazaphthalide is encapsulated within microcapsules.

7. The recording material according to claim 1, comprising:

a color former sheet comprising a substrate coated with microcapsules encapsulating the indolylazaphthalide dissolved in a solvent and a developer sheet coated with a combination of a dispersion, in a binder, of an electron accepting compound and a pigment.

8. The recording material according to claim 1, wherein a heat-sensitive color forming layer comprises, in addition to the electron donative colorless dye or the electron accepting compound, a heat-meltable substance selected from the group consisting of aromatic ethers, thioethers, esters, and aliphatic amides or ureidos.

9. The recording material according to claim 8, wherein the amount of the heat-meltable substance is between 20% by weight and 300% by weight inclusive with respect to the electron accepting compound.

10. A multi-color heat-sensitive recording material comprising a support having thereon two heat-sensitive layers in which two diazonium salt compounds having different sensitization wavelengths are combined with couplers which develop different hues after reaction in the presence of heat, an electron donative colorless dye, and an electron accepting compound, wherein the electron donative colorless dye comprises indolylazaphthalide represented by the following formula (I):

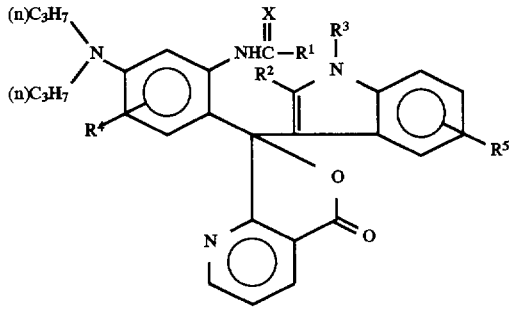

(I)

wherein $R^1$ represents an alkyl group, a cycloalkyl group, an aralkyl group, an aryl group, or a heterocyclic group; each of $R^2$ and $R^3$ represents a hydrogen atom, an alkyl group, or an aryl group; each of $R^4$ and $R^5$ represents a hydrogen atom, an alkyl group, an alkoxy group, or a halogen atom; and X represents an oxygen atom or a sulfur atom.

11. The multi-color heat-sensitive recording material according to claim 10, comprising a support, a first heat-sensitive recording layer containing an electron donative colorless dye formed of the indolylazaphthalide and an electron accepting compound, a second heat-sensitive recording layer containing a diazonium salt compound having a maximum absorption wavelength of 360 nm±20 nm and a coupler reacting with the diazonium salt compound in the presence of heat to develop a color, and a third heat-sensitive recording layer containing a diazonium salt compound having a maximum absorption wavelength of 400 nm±20 nm and a coupler reacting with the diazonium salt compound in the presence of heat to develop a color, wherein the first through third layers are superposed on the support.

* * * * *